US011688316B2

(12) United States Patent
Feng et al.

(10) Patent No.: US 11,688,316 B2
(45) Date of Patent: *Jun. 27, 2023

(54) PIXEL CIRCUIT AND DRIVING METHOD THEREFOR, ARRAY SUBSTRATE, DISPLAY PANEL, AND ELECTRONIC DEVICE

(71) Applicants: Hefei BOE Joint Technology Co., Ltd., Anhui (CN); BOE TECHNOLOGY GROUP CO., LTD., Beijing (CN)

(72) Inventors: Xuehuan Feng, Beijing (CN); Yongqian Li, Beijing (CN)

(73) Assignees: Hefei BOE Joint Technology Co., Ltd., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/944,523

(22) Filed: Sep. 14, 2022

(65) Prior Publication Data

US 2023/0052249 A1 Feb. 16, 2023

Related U.S. Application Data

(63) Continuation of application No. 17/420,054, filed as application No. PCT/CN2020/111486 on Aug. 26, 2020, now Pat. No. 11,495,153.

(30) Foreign Application Priority Data

Aug. 27, 2019 (CN) ..... 201910799367.7

(51) Int. Cl.
*G09G 3/00* (2006.01)
*G09G 3/3275* (2016.01)

(52) U.S. Cl.
CPC ..... *G09G 3/006* (2013.01); *G09G 3/3275* (2013.01); *G09G 2330/12* (2013.01)

(58) Field of Classification Search
CPC . G09G 3/006; G09G 3/3275; G09G 2330/012
See application file for complete search history.

(56) References Cited

U.S. PATENT DOCUMENTS 11,495,153 B2 * 11/2022 Feng ..... G09G 3/3275
2002/0140364 A1 10/2002 Inukai
(Continued)

FOREIGN PATENT DOCUMENTS

CN 101449311 A 6/2009
CN 103050080 A 4/2013
(Continued)

OTHER PUBLICATIONS

The First Office Action for the Chinese Patent Application No. 201910799367.7 issued by the Chinese Patent Office dated Jun. 29, 2020.
(Continued)

*Primary Examiner* — Kenneth B Lee, Jr.
(74) *Attorney, Agent, or Firm* — IP & T Group LLP

(57) ABSTRACT

A pixel circuit includes a data line, a sensing line, a first pixel sub-circuit and a second pixel sub-circuit. The first pixel sub-circuit includes a first writing unit, a first sensing unit and a first driving unit. The first driving unit is configured to drive a first light-emitting unit to emit light. The second pixel sub-circuit includes a second writing unit, a second sensing unit and a second driving unit. The second driving unit is configured to drive a second light-emitting unit to emit light. The first writing unit and the second sensing unit are both configured to be connected to a gate driving unit. The second writing unit and the first sensing unit are both configured to be connected to another gate driving unit.

20 Claims, 8 Drawing Sheets

(56) References Cited

U.S. PATENT DOCUMENTS

| | | | |
|---|---|---|---|
| 2007/0195020 | A1 | 8/2007 | Nathan et al. |
| 2014/0022289 | A1 | 1/2014 | Lee et al. |
| 2014/0292624 | A1 | 10/2014 | Choi et al. |
| 2015/0130785 | A1 | 5/2015 | Shin et al. |
| 2015/0179105 | A1 | 6/2015 | Mizukoshi |
| 2017/0162112 | A1 | 6/2017 | Ha |
| 2017/0193923 | A1 | 7/2017 | Park et al. |
| 2018/0005581 | A1 | 1/2018 | Kim et al. |
| 2019/0131376 | A1 | 5/2019 | Hong et al. |
| 2020/0202786 | A1 | 6/2020 | Li et al. |
| 2021/0201804 | A1 | 7/2021 | Feng et al. |
| 2021/0201810 | A1 | 7/2021 | Feng et al. |
| 2022/0084448 | A1 | 3/2022 | Feng et al. |

FOREIGN PATENT DOCUMENTS

| | | | |
|---|---|---|---|
| CN | 103413521 | A | 11/2013 |
| CN | 103578411 | A | 2/2014 |
| CN | 104637443 | A | 5/2015 |
| CN | 104732920 | A | 6/2015 |
| CN | 106960658 | A | 7/2017 |
| CN | 107068065 | A | 8/2017 |
| CN | 107564465 | A | 1/2018 |
| CN | 109166527 | A | 1/2019 |
| CN | 109523954 | A | 3/2019 |
| CN | 109727574 | A | 5/2019 |
| CN | 109935212 | A | 6/2019 |
| CN | 110491337 | A | 11/2019 |
| KR | 10-2014-0140736 | A | 12/2014 |
| KR | 10-2015-0079090 | A | 7/2015 |

OTHER PUBLICATIONS

Non-final Office Action for the U.S. Appl. No. 17/420,054 issued by the USPTO dated Mar. 14, 2022.

Notice of Allowance for the U.S. Appl. No. 17/420,054 issued by the USPTO dated Jul. 1, 2022.

Corrected Notice of Allowance for the U.S. Appl. No. 17/420,054 issued by the USPTO dated Jul. 18, 2022.

International Search Report and Written Opinion issued for the International Application No. PCT/CN2020/111486 issued by the Chinese Patent Office dated Nov. 27, 2020.

* cited by examiner

PIXEL CIRCUIT AND DRIVING METHOD THEREFOR, ARRAY SUBSTRATE, DISPLAY PANEL, AND ELECTRONIC DEVICE

CROSS-REFERENCE TO RELATED APPLICATIONS

This application is a continuation of U.S. patent application Ser. No. 17/420,054, filed on Jun. 30, 2021, which claims priority to International Patent Application No. PCT/CN2020/111486, filed on Aug. 26, 2020, which in turn claims priority to Chinese Patent Application No. 201910799367.7, filed on Aug. 27, 2019, which are incorporated herein by reference in their entirety.

TECHNICAL FIELD

The present disclosure relates to the field of display technologies, for example, to a pixel circuit and a driving method therefor, an array substrate, a display panel, and an electronic device.

BACKGROUND

In the display field, for example, in the organic light-emitting diode (OLED) display, a pixel circuit is generally of a 3T1C structure, and the pixel circuit is driven by a gate driver on array (GOA, a row driver on an array substrate) circuit. The GOA circuit is an effective means of reducing panel defects and costs.

SUMMARY

In an aspect, a pixel circuit is provided. The pixel circuit includes a data line, a sensing line, a first pixel sub-circuit and a second pixel sub-circuit. The first pixel sub-circuit includes a first writing unit, a first sensing unit and a first driving unit. The first writing unit is connected to the data line and the first driving unit, the first sensing unit is connected to the sensing line and the first driving unit, and the first driving unit is configured to be connected to a first light-emitting unit to drive the first light-emitting unit to emit light. The second pixel sub-circuit includes a second writing unit, a second sensing unit and a second driving unit. The second writing unit is connected to the data line and the second driving unit, the second sensing unit is connected to the sensing line and the second driving unit, and the second driving unit is configured to be connected to a second light-emitting unit to drive the second light-emitting unit to emit light. The first writing unit and the second sensing unit are both configured to be connected to a gate driving unit. The second writing unit and the first sensing unit are both configured to be connected to another gate driving unit.

In some embodiments, the pixel circuit further includes a first driving line and a second driving line. The first writing unit and the second sensing unit are both connected to the first driving line, and the first driving line is configured to be connected to the gate driving unit. The second writing unit and the first sensing unit are both connected to the second driving line, and the second driving line is configured to be connected to the another gate driving unit.

In some embodiments, an effective-level duration of a signal transmitted by the first driving line is at least partially overlapped with an effective-level duration of another signal transmitted by the second driving line.

In some embodiments, the pixel circuit further includes a first driving line and a second driving line. A first terminal of the first writing unit is connected to the data line, and a control terminal of the first writing unit is connected to the first driving line. A first terminal of the first sensing unit is connected to the sensing line, and a control terminal of the first sensing unit is connected to the second driving line. A control terminal of the first driving unit is connected to a second terminal of the first writing unit, a first terminal of the first driving unit is configured to be connected to a first power supply, a second terminal of the first driving unit is connected to a second terminal of the first sensing unit, and the second terminal of the first driving unit is configured to be connected to the first light-emitting unit. A first terminal of the second writing unit is connected to the data line, and a control terminal of the second writing unit is connected to the second driving line. A first terminal of the second sensing unit is connected to the sensing line, and a control terminal of the second sensing unit is connected to the first driving line. A control terminal of the second driving unit is connected to a second terminal of the second writing unit, a first terminal of the second driving unit is configured to be connected to the first power supply, a second terminal of the second driving unit is connected to a second terminal of the second sensing unit, and the second terminal of the second driving unit is configured to be connected to the second light-emitting unit.

In some embodiments, the first writing unit includes a first writing transistor; a first terminal, a second terminal and a control terminal of the first writing transistor are the first terminal, the second terminal and the control terminal of the first writing unit, respectively. The second writing unit includes a second writing transistor; a first terminal, a second terminal and a control terminal of the second writing transistor are the first terminal, the second terminal and the control terminal of the second writing unit, respectively.

In some embodiments, the first sensing unit includes a first sensing transistor; first terminal, a second terminal and a control terminal of the first sensing transistor are the first terminal, the second terminal and the control terminal of the first sensing unit, respectively. The second sensing unit includes a second sensing transistor; a first terminal, a second terminal and a control terminal of the second sensing transistor are the first terminal, the second terminal and the control terminal of the second sensing unit, respectively.

In some embodiments, the first driving unit includes a first driving transistor and a first storage capacitor. A first terminal, a second terminal and a control terminal of the first driving transistor are the first terminal, the second terminal and the control terminal of the first driving unit, respectively. A terminal of the first storage capacitor is connected to the control terminal of the first driving transistor, and another terminal of the first storage capacitor is connected to the second terminal of the first driving transistor. The second driving unit includes a second driving transistor and a second storage capacitor. A first terminal, a second terminal and a control terminal of the second driving transistor are the first terminal, the second terminal and the control terminal of the second driving unit, respectively. A terminal of the second storage capacitor is connected to the control terminal of the second driving transistor, and another terminal of the second storage capacitor is connected to the second terminal of the second driving transistor.

In some embodiments, the pixel circuit further includes the first light-emitting unit and the second light-emitting unit. A terminal of the first light-emitting unit is connected to the second terminal of the first driving transistor, and another terminal of the first light-emitting unit is configured to be connected to a second power supply. A terminal of the second light-emitting unit is connected to the second terminal of the second driving transistor, and another terminal of the second light-emitting unit is configured to be connected to the second power supply.

In some embodiments, the first driving line and the second driving line are configured to be connected to output terminals of gate driving units in two adjacent rows in a gate driving circuit.

In some embodiments, a turn-on duration of the first writing unit is at least partially overlapped with a turn-on duration of the second sensing unit. A turn-on duration of the second writing unit is at least partially overlapped with a turn-on duration of the first sensing unit.

In another aspect, an array substrate is provided. The array substrate includes a plurality of pixel circuits in any one of the above embodiments.

In some embodiments, first pixel sub-circuits and second pixel sub-circuits in the plurality of pixel circuits constitute a pixel array. The first pixel sub-circuit and the second pixel sub-circuit in a pixel circuit in the plurality of pixel circuits are located in two adjacent rows of the pixel array.

In yet another aspect, a display panel is provided. The display panel includes the array substrate in any one of the above embodiments.

In yet another aspect, an electronic device is provided. The electronic device includes the display panel in any one of the above embodiments.

In yet another aspect, a driving method of a pixel circuit is provided, and is used for driving the pixel circuit in any one of the above embodiments. The pixel circuit further includes a first driving line and a second driving line. The first writing unit and the second sensing unit are both connected to the first driving line, and the first driving line is configured to be connected to the gate driving unit. The second writing unit and the first sensing unit are both connected to the second driving line, and the second driving line is configured to be connected to the another gate driving unit. An operation mode of the pixel circuit includes a display mode. In the display mode, the method includes at least one first period, and a first period in the at least one first period includes first to fourth phases. In the first phase of the display mode, the first driving line transmits a first to on signal. The first writing unit is turned on under a control of the first turn-on signal, so as to precharge a control terminal of the first driving unit. In the second phase of the display mode, the first driving line transmits the first turn-on signal, and the second driving line transmits a second turn-on signal. The first writing unit is turned on under the control of the first turn-on signal, so as to write a first data voltage of the data line into the control terminal of the first driving unit. The second writing unit is turned on under a control of the second turn-on signal, so as to precharge a control terminal of the second driving unit. In the third phase of the display mode, the first driving line transmits a first turn-off signal, and the second driving line transmits the second turn-on signal. The first writing unit is turned off under a control of the first turn-off signal, so as to maintain a potential of the control terminal of the first driving unit. The second writing unit is turned on under the control of the second turn-on signal, so as to write a second data voltage of the data line into the control terminal of the second driving unit. In the fourth phase of the display mode, the first driving line transmits the first turn-off signal, and the second driving line transmits a second turn-off signal. The first writing unit is turned off under the control of the first turn-off signal, and the first sensing unit is turned off under a control of the second turn-off signal, so that the first driving unit drives the first light-emitting unit to emit light. The second writing unit is turned off under the control of the second turn-off signal, and the second sensing unit is turned off under the control of the first turn-off signal, so that the second driving unit drives the second light-emitting unit to emit light.

In some embodiments, the operation mode of the pixel circuit further includes a sense mode. In the sense mode, the method includes at least one second period, a second period in the at least one second period includes a data writing-back phase. In the data writing-back phase of the sense mode, the first driving line transmits a first turn-on signal, and the second driving line transmits a second turn-on signal. The first writing unit and the second sensing unit are turned on under a control of the first turn-on signal, and the first sensing unit and the second writing unit are turned on under a control of the second turn-on signal, so that a data voltage output from the data line is written into the control terminal of the first driving unit and the control terminal of the second driving unit synchronously, and a reference voltage output from the sensing line is written to a first node and a second node synchronously. The first driving unit and the first light-emitting unit are connected to the first node, and the second driving unit and the second light-emitting unit are connected to the second node.

In some embodiments, before the data writing-back phase of the sense mode, the second period further includes a first data writing phase, a first charging phase, and a first sampling phase. In the first data writing phase, the first driving line transmits the first turn-on signal, and the second driving line transmits the second turn-on signal. The first writing unit is turned on under the control of the first turn-on signal, and the first sensing unit is turned on under the control of the second turn-on signal, so that a data voltage output from the data line is written into the control terminal of the first driving unit, and the reference voltage output from the sensing line is written into the first node. In the first charging phase, the first driving line transmits a first turn-off signal, and the second driving line transmits the second turn-on signal. The first writing unit is turned off under a control of the first turn-off signal, and the first sensing unit is turned on under the control of the second turn-on signal, so that the first power supply charges the first node through the first driving unit, so as to make a potential of the sensing line change with a potential of the first node. In the first sampling phase, the first driving line transmits the first turn-off signal, and the second driving line transmits the second turn-on signal. The first writing unit is turned off under the control of the first turn-off signal, and the first sensing unit is turned on under the control of the second turn-on signal, so as to read the potential of the sensing line through an external circuit to sense a threshold voltage of the first driving unit.

In some embodiments, before the data writing-back phase of the sense mode and after the first sampling phase, the second period further includes a second data writing phase, a second charging phase, and a second sampling phase. In the second data writing phase, the first driving line transmits the first turn-on signal, and the second driving line transmits the second turn-on signal. The second writing unit is turned on under the control of the second turn-on signal, and the second sensing unit is turned on under the control of the first turn-on signal, so that a data voltage output from the data line is written into the control terminal of the second driving unit, and the reference voltage output from the sensing line is written to the second node. In the second charging phase, the second driving line transmits a second turn-off signal, and the first driving line transmits the first turn-on signal.

The second writing unit is turned off under a control of the second turn-off signal, and the second sensing unit is turned on under the control of the first turn-on signal, so that the first power supply charges the second node through the second driving unit, so as to make the potential of the sensing line change with a potential of the second node. In the second sampling phase, the second driving line transmits the second turn-off signal, and the first driving line transmits the first turn-on signal. The second writing unit is turned off under the control of the second turn-off signal, and the second sensing unit is turned on under the control of the first turn-on signal, so as to read the potential of the sensing line through the external circuit to sense a threshold voltage of the second driving unit.

In some embodiments, the driving method of the pixel circuit further includes: in the second phase of the display mode, compensating the first data voltage according to a cross voltage of the first light-emitting unit.

In some embodiments, the driving method of the pixel circuit further includes: in the third phase of the display mode, compensating the second data voltage according to a cross voltage of the second light-emitting unit.

BRIEF DESCRIPTION OF THE DRAWINGS

In order to describe technical solutions in the present disclosure more clearly, accompanying drawings to be used in some embodiments of the present disclosure will be introduced briefly below Obviously, the accompanying drawings to be described below are merely accompanying drawings of some embodiments of the present disclosure, and a person of ordinary skill in the art may obtain other drawings according to these drawings. In addition, the accompanying drawings to be described below may be regarded as schematic diagrams, but are not limitations on actual sizes of products, actual processes of methods and actual timings of signals involved in the embodiments of the present disclosure.

DETAILED DESCRIPTION

Figure 1:
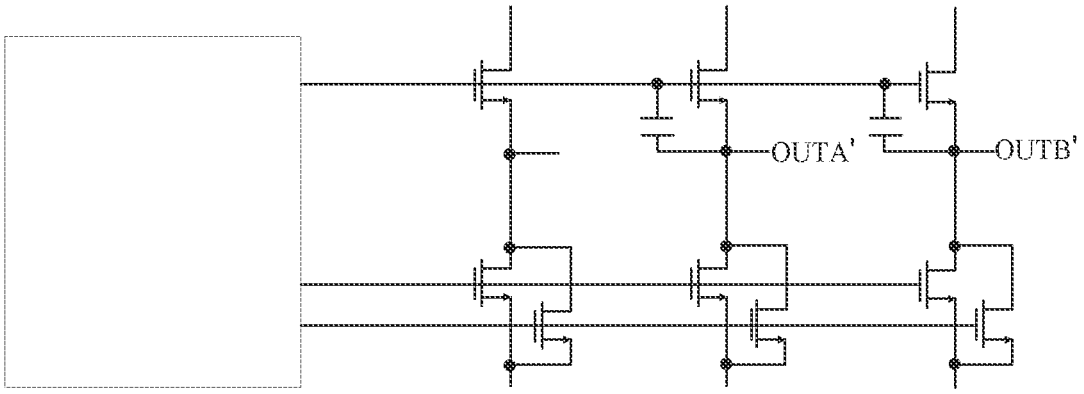
FIG. 1 is a schematic circuit diagram of a gate driving circuit corresponding to a pixel circuit, in accordance with some embodiments.

Technical solutions in some embodiments of the present disclosure will be described clearly and completely with reference to the accompanying drawings below. Obviously, the described embodiments are merely some but not all embodiments of the present disclosure. All other embodiments obtained by a person of ordinary skill in the art based on the embodiments of the present disclosure shall be included in the protection scope of the present disclosure.

Unless the context requires otherwise, throughout the description and the claims, the term "comprise" and other forms thereof such as the third-person singular form "comprises" and the present participle form "comprising" are construed as an open and inclusive meaning, i.e., "including, but not limited to". In the description of the specification the terms such as "one embodiment", "some embodiments", "exemplary embodiments", "an example", "specific example" or "some examples" are intended to indicate that specific features, structures, materials or characteristics related to the embodiment(s) or example(s) are included in at least one embodiment or example of the present disclosure. Schematic representations of the above terms do not necessarily refer to the same embodiment(s) or example(s). In addition, the specific features, structures, materials, or characteristics may be included in any one or more embodiments or examples in any suitable manner.

Below, the terms "first" and "second" are only used for descriptive purposes, and are not to be construed as indicating or implying the relative importance or implicitly indicating the number of indicated technical features. Thus, a feature defined with "first" or "second" may explicitly or implicitly include one or more of the features. In the description of the embodiments of the present disclosure, the term "a plurality of/the plurality of" means two or more unless otherwise specified.

In the description of some embodiments, the terms such as "coupled" and "connected" and derivatives thereof may be used. For example, the term "connected" may be used in the description of some embodiments to indicate that two or more components are in direct physical or electrical contact with each other. For another example, the term "coupled" may be used in the description of some embodiments to indicate that two or more components are in direct physical or electrical contact with each other. However, the term "coupled" or "communicatively coupled" may also mean that two or more components are not in direct contact with each other, but still cooperate or interact with each other. The embodiments disclosed herein are not necessarily limited to the contents herein.

The use of "applicable to" or "configured o" herein indicates an open and inclusive expression, which does not exclude devices that are applicable to or configured to perform additional tasks or steps.

In addition, the use of the phrase "based on" is meant to be open and inclusive, since a process, step, calculation or other action that is "based on" one or more of the stated conditions or values may, in practice, be based on additional conditions or values other than those stated.

Exemplary embodiments are described herein with reference to sectional views and/or plan views as idealized exemplary drawings. In the accompanying drawings, thicknesses of layers and sizes of regions are enlarged for clarity. Variations in shapes with respect to the drawings due to, for example, manufacturing techniques and/or tolerances may be conceivable. Therefore, the exemplary embodiments should not be construed to be limited to the shapes of the regions shown herein, but to include the deviations in shapes due to, for example, manufacturing. For example, an etched region that is shown to have a rectangular shape generally has a curved feature. Therefore, the regions shown in the accompanying drawings are schematic in nature, and their shapes are not intended to show actual shapes of the regions in a device, and are not intended to limit the scope of the exemplary embodiments.

Some embodiments of the present disclosure are described below in detail. Examples of the embodiments are shown in the accompanying drawings. Same or similar reference numerals consistently indicate same or similar elements, or elements with same or similar functions. The embodiments described below with reference to the accompanying drawings are exemplary, which are intended to explain the present disclosure, and shall not be construed to be limitations on the present disclosure.

In some examples, a pixel circuit is of 3T1C structure, and needs two gate driving lines. In this case, as shown in FIG. 1, a corresponding GOA circuit is required to have two output terminals OUTA' and OUTB'.

Based on this, some embodiments of the present disclosure provide a pixel circuit and a driving method therefor, an array substrate, a display panel, and an electronic device. The pixel circuit and the driving method therefor, the array substrate, the display panel, and the electronic device in some embodiments of the present disclosure will be described below with reference to the accompanying drawings.

Figure 2:
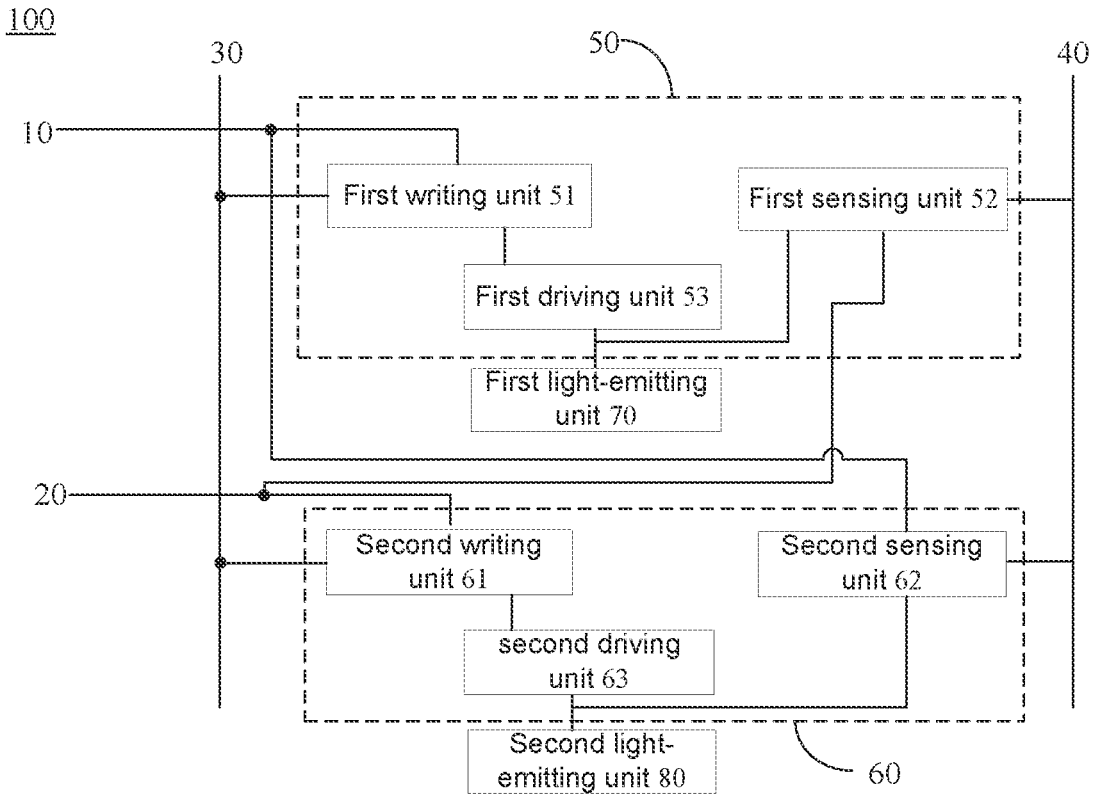
FIG. 2 is a block diagram of a pixel circuit, in accordance with some embodiments.

FIG. 2 is a schematic block diagram of the pixel circuit 100 in accordance with some embodiments of the present disclosure. As shown in FIG. 2, the pixel circuit 100 in some embodiments of the present disclosure includes a first driving line 10, a second driving line 20, a data line 30, a sensing line 40, a first pixel sub-circuit 50, and a second pixel sub-circuit 60. The first pixel sub-circuits 50 and the second pixel sub-circuits 60 are located in two adjacent rows of a pixel array, and the pixel array includes a plurality of pixel sub-circuits arranged in an array.

It can be understood that the plurality of pixel sub-circuits include both the first pixel sub-circuits 50 and the second pixel sub-circuits 60. For example, the pixel array has N rows and M columns, and N is an even number. Then, the pixel array of N rows and M columns includes N/2 by M (N/2×M) pixel circuits 100 in the embodiment in FIG. 2 or FIG. 4. That is, the pixel circuit 100 may be arranged in two adjacent rows and in the same column of the pixel array. That is, in each column of the pixel array, the pixel circuit 100 in the embodiment in FIG. 2 or FIG. 4 may be in a (2i-1)-th row and a 2i-th row, and i=1, 2 . . . N/2. In this case, the first pixel sub-circuit 50 may be located in an odd row of the pixel array, i.e., the (2i-1)-th row, and the second pixel sub-circuit 60 may be located in an even row of the pixel array, i.e., the 2i-th row. Alternatively, the first pixel sub-circuit 50 may be located in the even row of the pixel array, i.e., the 2i-th row, and the second pixel sub-circuit 60 may be located in the odd row of the pixel array, i.e., the (2i-1)-th row.

The first pixel sub-circuit 50 includes a first writing unit 51, a first sensing unit 52, and a first driving unit 53. The first writing unit 51 is connected to the data line 30 and the first driving unit 53, the first sensing unit 52 is connected to the sensing line 40 and the first driving unit 53, and the first driving unit 53 is further connected to a first light-emitting unit 70 to drive the first light-emitting unit 70 to emit light.

The second pixel sub-circuit 60 includes a second writing unit 61, a second sensing unit 62, and a second driving unit 63. The second writing unit 61 is connected to the data line 30 and the second driving unit 63, the second sensing unit 62 is connected to the sensing line 40 and the second driving unit 63, and the second driving unit 63 is to further connected to a second light-emitting unit 80 to drive the second light-emitting unit 80 to emit light.

As shown in FIG. 1, the first writing unit 51 and the second sensing unit 62 are both configured to be connected to a gate driving unit, and the second writing unit 61 and the first sensing unit 52 are both configured to be connected to another gate driving unit.

In some embodiments, as shown in FIG. 2, the first writing unit 51 and the second sensing unit 62 are further connected to the first driving line 10, so as to be turned on or off synchronously under a control of the first driving line 10. The second writing unit 61 and the first sensing unit 52 are further connected to the second driving line 20, so as to be turned on or off synchronously under a control of the second driving line 20. For example, as shown FIG. 1, OUTA' is connected to the first driving line 10, and OUTB' is connected to the second driving line 20.

According to some embodiments of the present disclosure, the first driving line 10 and the second driving line 20 are connected to output terminals of gate driving units in two adjacent rows in a gate driving circuit, respectively. For example, the first pixel sub-circuit 50 is located in a first pixel row, and the first driving line 10 is connected to an output terminal of a gate driving unit in a first row in the gate driving circuit. The second pixel sub-circuit 60 is located in a second pixel row, and the second driving line 20 is connected to an output terminal of a gate driving unit in a second row in the gate driving circuit.

Figure 3:
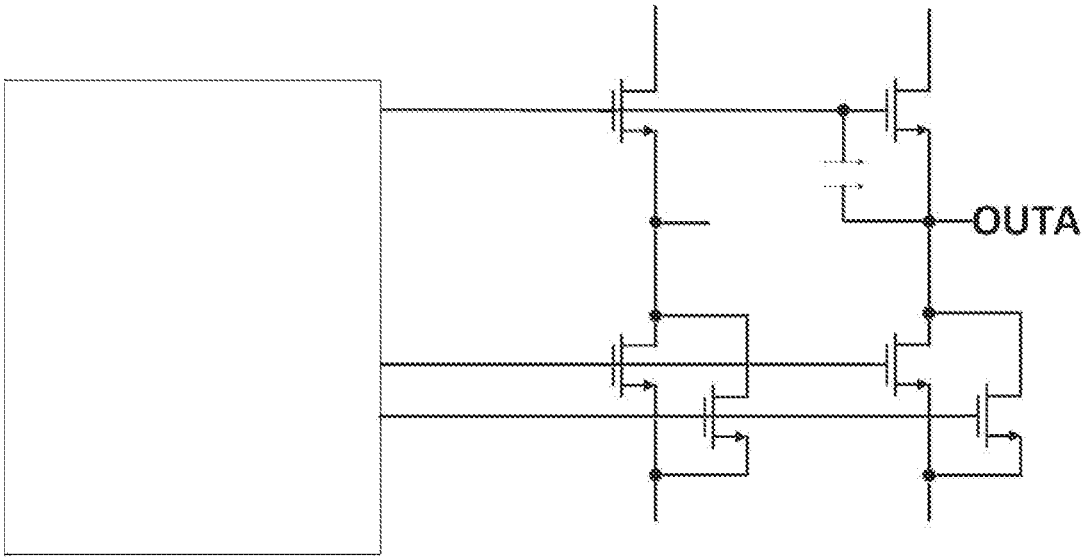
FIG. 3 is a schematic circuit diagram of a gate driving circuit corresponding to a pixel circuit, in accordance with some embodiments.

Therefore, the pixel circuit 100 in some embodiments of the present disclosure uses two rows as a basic unit, by connecting the first writing unit 51 in the first pixel sub-circuit 50 and the second sensing unit 62 in the second pixel sub-circuit 60 to one driving line (e.g., the first driving line 10), and by connecting the second writing unit 61 in the second pixel sub-circuit 60 and the first sensing unit 52 in the first pixel sub-circuit 50 to another driving line (e.g., the second sensing line 20), two pixel sub-circuits (i.e., the first pixel sub-circuit 50 and the second pixel sub-circuit 60) in each pixel circuit 100 are only required to be connected to two output terminals of gate driving units in two rows in the gate driving circuit. That is, only one output terminal is required for each row gate driving unit in the gate driving circuit corresponding to the pixel circuits 100. As shown in FIG. 3, the gate driving unit has one output terminal OUTA. Obviously, compared to the gate driving circuit shown in FIG. 1, the number of output terminals is reduced by one, thereby reducing a bezel of a display panel.

Figure 5:
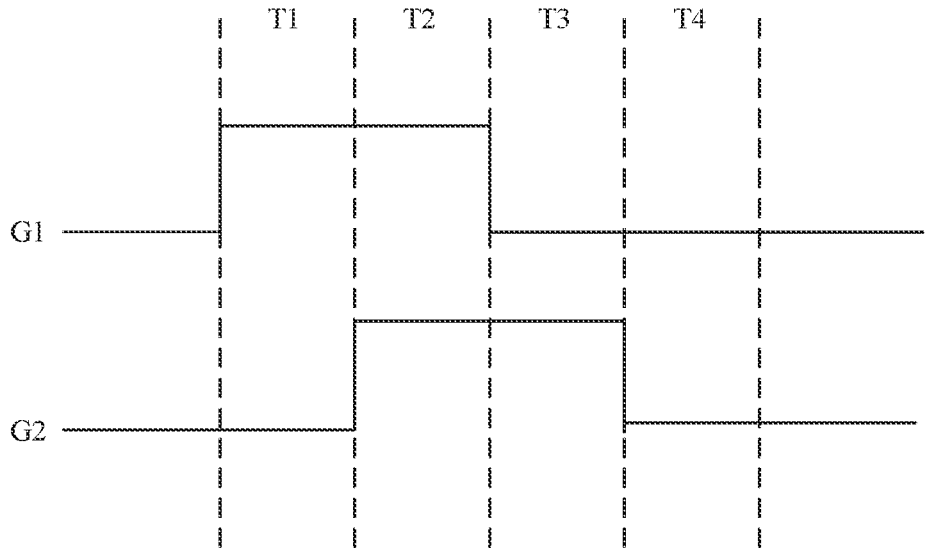
FIG. 5 is a timing diagram of a pixel circuit, in accordance with some embodiments.

In some embodiments, as shown in FIG. 5, an effective-level duration of a signal transmitted by the first driving line 10 is at least partially overlapped with an effective-level duration of another signal transmitted by the second driving line 20.

The specific circuit structure of the pixel circuit 100 in some embodiments of the present disclosure will be described in detail below with reference to FIG. 4.

Figure 4:
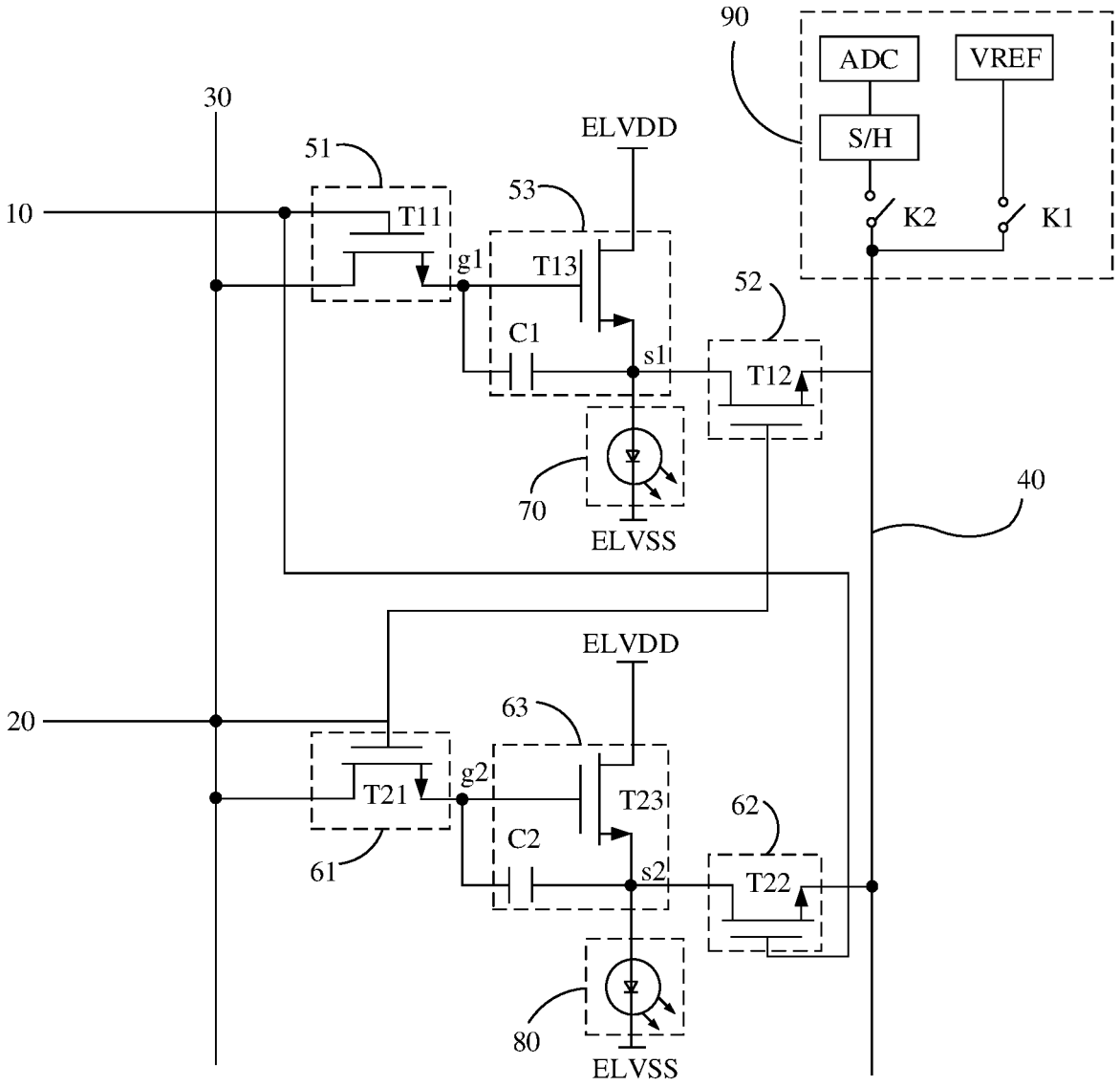
FIG. 4 is a schematic circuit diagram of a pixel circuit, in accordance with some embodiments.

In some embodiments, as shown in FIG. 4, a first terminal of the first writing unit 51 is connected to the data line 30, and a control terminal of the first writing unit 51 is connected to the first driving line 10.

A first terminal of the first sensing unit 52 is connected to the sensing line 40, and a control terminal of the first sensing unit 52 is connected to the second driving line 20.

A control terminal of the first driving unit 53 is connected to a second terminal of the first writing unit 51, a first terminal of the first driving unit 53 is connected to a first power supply ELVDD, and a second terminal of the first driving unit 53 is connected to a second terminal of the first sensing unit 52. The second terminal of the first driving unit 53 is further connected to the first light-emitting unit 70.

A first terminal of the second writing unit 61 is connected to the data line 30, and a control terminal of the second writing unit 61 is connected to the second driving line 20.

A first terminal of the second sensing unit 62 is connected to the sensing line 40, and a control terminal of the second sensing unit 62 is connected to the first driving line 10.

A control terminal of the second driving unit 63 is connected to a second terminal of the second writing unit 61 a first terminal of the second driving unit 63 is connected to the first power supply ELVDD, and a second terminal of the second driving unit 63 is connected to a second terminal of the second sensing unit 62. The second terminal of the second driving unit 63 is further connected to the second light-emitting unit 80.

For example, as shown in FIG. 4, the first writing unit 51 includes a first writing transistor T11. A first terminal of the first writing transistor T11 is configured as the first terminal of the first writing unit 51, a second terminal of the first writing transistor T11 is configured as the second terminal of the first writing unit 51, and a control terminal of the first writing transistor T11 is configured as the control terminal of the first writing unit 51. That is, the first terminal of the first writing transistor T11 is connected to the data line 30, the control terminal of the first writing transistor T11 is connected to the first driving line 10, and the second terminal of the first writing transistor T11 is connected to the control terminal of the first driving unit 53.

The second writing unit 61 includes a second writing transistor T21. A first terminal of the second writing transistor T21 is configured as the first terminal of the second writing unit 61, and a second terminal of the second writing transistor T21 is configured as the second terminal of the second writing unit 61, and a control terminal of the second writing transistor T21 is configured as the control terminal of the second writing unit 61. That is, the first terminal of the second writing transistor T21 is connected to the data line 30, the control terminal of the second writing transistor T21 is connected to the second driving line 20, and the second terminal of the second writing transistor T21 is connected to the control terminal of the second driving unit 63.

For example, as shown in FIG. 4, the first sensing unit 52 includes a first sensing transistor T12. A first terminal of the first sensing transistor T12 is configured as the first terminal of the first sensing unit 52, a second terminal of the first sensing transistor T12 is configured as the second terminal of the first sensing unit 52, and a control terminal of the first sensing transistor T12 is configured as the control terminal of the first sensing unit 52. That is, the first terminal of the first sensing transistor T12 is connected to the sensing line 40, the second terminal of the first sensing transistor T12 is connected to the second terminal of the first driving unit 53, and the control terminal of the first sensing transistor T12 is connected to the second driving line 20.

The second sensing unit 62 includes a second sensing transistor T22. A first terminal of the second sensing transistor T22 is configured as the first terminal of the second sensing unit 62, a second terminal of the second sensing transistor T22 is configured as the second terminal of the second sensing unit 62, and a control terminal of the second sensing transistor T22 is configured as the control terminal of the second sensing unit 62. That is, the first terminal of the second sensing transistor T22 is connected to the sensing line 40, the second terminal of the second sensing transistor T22 is connected to the second terminal of the second driving unit 63, and the control terminal of the second sensing transistor T22 is connected to the first driving line 10.

For example, as shown in FIG. 4, the first driving unit 53 includes a first driving transistor T13 and a first storage capacitor C1. A first terminal of the first driving transistor T13 is configured as the first terminal of the first driving unit 53, a second terminal of the first driving transistor T13 is configured as the second terminal of the first driving unit 53, and a control terminal of the first driving transistor T13 is configured as the control terminal of the first driving unit 53. In this case, the first terminal of the first driving transistor T13 is connected to the first power supply ELVDD, the second terminal of the first driving transistor T13 is connected to a terminal of the first light-emitting unit 70, and another terminal of the first light-emitting unit 70 is connected to a second power supply ELVSS, and the control terminal of the first driving transistor T13 is connected to the first writing unit 51. A terminal of the first storage capacitor C1 is connected to the control terminal of the first driving transistor T13, and another terminal of the first storage capacitor C1 is connected to the second terminal of the first driving transistor T13.

The second driving unit 63 includes a second driving transistor T23 and a second storage capacitor C2. A first terminal of the second driving transistor T23 is configured as the first terminal of the second driving unit 63, and a second terminal of the second driving transistor T23 is configured as the second terminal of the second driving unit 63, and a control terminal of the second driving transistor T23 is configured as the control terminal of the second driving unit 63. In this case, the first terminal of the second driving transistor T23 is connected to the first power supply ELVDD, the second terminal of the second driving transistor T23 is connected to a terminal of the second light-emitting unit 80, another terminal of the second light-emitting unit 80 is connected to the second power supply ELVSS, and the control terminal of the second driving transistor T23 is connected to the second writing unit 61. A terminal of the second storage capacitor C2 is connected to the control terminal of the second driving transistor T23, and another terminal of the second storage capacitor C2 is connected to the second terminal of the second driving transistor T23.

The first driving transistor T13 is connected to the first light-emitting unit 70 to form a first node 51, and the second driving transistor T23 is connected to the second light-emitting unit 80 to form a second node s2.

An operation principle of the pixel circuit in the embodiment in FIG. 4 will be described with reference to the timing diagrams in FIGS. 5 and 6.

An operation mode of the pixel circuit in some embodiments of the present disclosure includes a display mode to a sense mode.

It will be noted that, the first writing transistor T11 and the second sensing transistor T22 must be transistors of the same type, and the second writing transistor T21 and the first sensing transistor T12 must be transistors of the same type. For example, the first writing transistor T11 and the second sensing transistor T22 may be NPN transistors, so that in a case where an output signal of the first driving line 10 is at a high level, the first writing transistor T11 and the second sensing transistor T22 are turned on. Alternatively, the first writing transistor T11 and the second sensing transistor T22 may also be PNP transistors, so that in a case where an output signal of the first driving line 10 is at a low level, the first writing transistor T11 and the second sensing transistor T22 are turned on. Similarly, the second writing transistor T21 and the first sensing transistor T12 may be NPN transistors, so that in a case where an output signal of the second driving line 20 is at a high level, the second writing transistor T21 and the first sensing transistor T12 are turned on. Alternatively, the second writing transistor T21 and the first sensing transistor T12 may be PNP transistors, so that in a case where an output signal of the second driving line 20 is at a low level, the second writing transistor T21 and the first sensing transistor are turned on.

The transistors used in the embodiments of the present disclosure may be thin film transistors, field effect transistors, or other switching devices with same characteristics, and the embodiments of the present disclosure are described by taking the thin film transistors as an example.

In addition, the control terminal of each transistor described above is a gate of the transistor, the first terminal is one of a source and a drain of the transistor, and the second terminal is another one of the source and the drain of the transistor. Since the source and the drain of the transistor may be symmetrical in structure, the source and the drain thereof may have no difference in structure. That is, the first terminal and the second terminal of the transistor in the embodiments of the present disclosure may be the same in structure. For example, in a case where the transistor is the NPN transistor, the first terminal of the transistor may be the source, and the second terminal may be the drain. For another example, in a case where the transistor is the PNP transistor, the first terminal of the transistor may be the drain, and the second terminal may be the source.

Some embodiments of the present disclosure are described by taking NPN metal oxide semiconductor field effect transistors (MOSFET) or insulated gate bipolar transistors (IGBT) as an example. It will be noted that the embodiments of the present disclosure include but are not limited thereto. For example, one or more transistors in the circuit in the embodiments of the present disclosure may also be PNP transistor(s), as long as terminals of selected-type transistors are connected correspondingly in accordance with the terminals of corresponding transistors in some embodiments of the present disclosure, and a corresponding voltage terminal provides a corresponding high voltage or low voltage.

FIG. 5 is a timing diagram in a case where the operation mode is the display mode. G1 is an output signal of the first driving line 10, and G2 is an output signal of the second driving line 20. FIG. 6 is a timing diagram in a case where the operation mode is the sense mode, G1 is an output signal of the first driving line 10, G2 is an output signal of the second driving line 20, DATA is a data voltage signal output from the data line 30, SENSE is a voltage signal of the sensing line 40. A reference voltage VREF is a low level voltage. In the display mode, a first switch K1 is closed.

In combination with the embodiment in FIG. 5, in a first phase T1 of the display mode, the first driving line 10 transmits a first turn-on signal, i.e., a high level signal. The first writing transistor T11 is turned on, so as to precharge the control terminal (i.e., g1 point) of the first driving transistor T13, i.e., to precharge the first storage capacitor C1

In a second phase T2 of the display mode, the first driving line 10 transmits the first turn-on signal, i.e., the high level signal, and the second driving line 20 transmits a second turn-on signal, i.e., a high level signal. The first writing transistor T11 continues to be turned on, so as to write a first data voltage (after obtaining a compensated data, write a compensated first data voltage) of the data line 30 into the control terminal of the first driving transistor T13, i.e., the g1 point. The second writing transistor T21 is turned on under a control of the second turn-on signal, so as to precharge the control terminal (i.e., g2 point) of the second driving transistor T23, i.e., to precharge the second storage capacitor C2. In addition, in this phase, the first data voltage may further be compensated according to a cross voltage of the first light-emitting unit 70. The cross voltage of the first light-emitting unit 70 is a voltage difference between the two terminals of the first light-emitting unit 70.

In a third phase T3 of the display mode, the first driving line 10 transmits a first turn-off signal, i.e., a low level signal, and the second driving line 20 transmits the second turn-on signal, i.e., the high level signal. The first writing transistor T11 is turned off under a control of the first turn-off signal, and a potential of the control terminal of the first driving transistor T13 is maintained through the first storage capacitor C1. In this case, due to the existence of the first storage capacitor C1, a voltage difference $V_{gs}$ between the control terminal and the second terminal of the first driving transistor T13 is unchanged. However, since the first sensing transistor T12 is turned on under the control of the second turn-on signal, the sensing line 40 provides the low level signal to the first node s1, and the first light-emitting unit 70 does not emit light. Moreover, the second sensing transistor T22 is turned off under the control of the first turn-off signal, and the second writing transistor T21 is turned on under the control of the second turn-on signal, so as to write a second data voltage (after obtaining a compensated data, write a compensated second data voltage) of the data line 30 into the control terminal (i.e., the point g2) of the second driving transistor T23. In addition, in this phase, the second data voltage may further be compensated according to a cross voltage of the second light-emitting unit 80. The cross voltage of the second light-emitting unit 80 is a voltage difference between the two terminals of the second light-emitting unit 80.

In a fourth phase T4 of the display mode, the first driving line 10 transmits the first turn-off signal, i.e., the low-level signal, and the second driving line 20 transmits a second turn-off signal, i.e., a low-level signal. The first writing transistor T11 is turned off under the control of the first turn-off signal, and the first sensing transistor T12 is turned off under a control of the second turn-off signal. In this case, the potential of the control terminal of the first driving transistor T13 is maintained at a high potential through the first storage capacitor C1, so that the first driving transistor T13 is turned on, and a voltage at the first node s1 is raised. Due to the action of the first storage capacitor C1, a voltage at the control terminal of the first driving transistor T13, i.e., a voltage at the point g1, is also raised through bootstrap, and the first driving transistor T13 drives the first light emitting unit 70 to emit light. In addition, the second writing transistor T21 is turned off under the control of the second turn-off signal, and the second sensing transistor T22 is turned off under the control of the first turn-off signal. In this case, a potential of the control terminal of the second driving transistor T23 is maintained at a high potential through the second storage capacitor C2, so that the second driving transistor T23 is turned on, and a voltage at the second node s2 is raised. Due to the action of the second storage capacitor C2, a voltage at the control terminal of the second driving transistor T23, i.e., a voltage at the point g2, is also raised through bootstrap, and the second driving transistor T23 drives the second light-emitting unit 80 to emit light.

Figure 6:
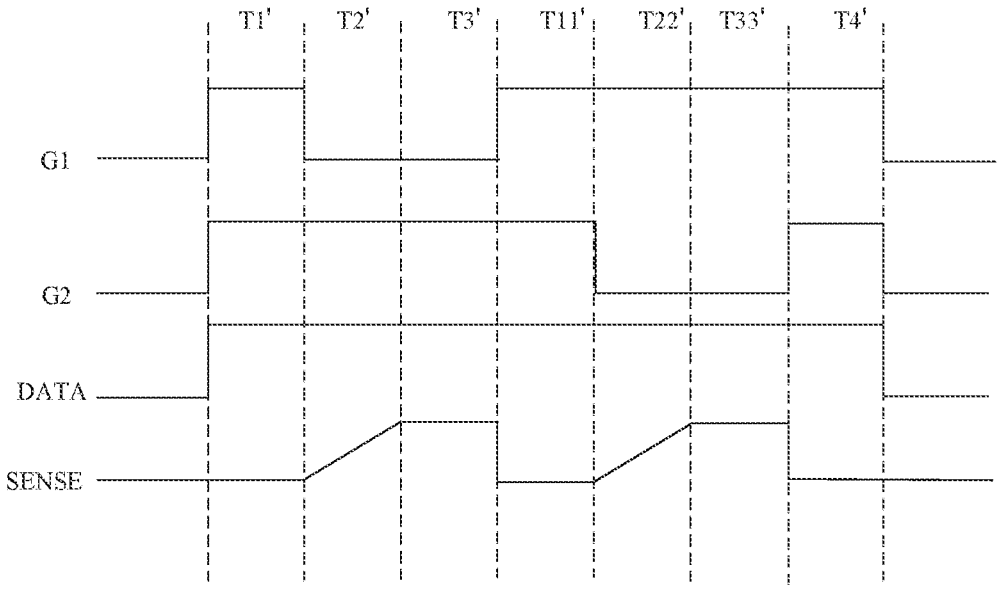
FIG. 6 is a timing diagram of another pixel circuit, in accordance with some embodiments.

In combination with the embodiment in FIG. 6, in a first data writing phase T1' of the sense mode, the first driving line 10 transmits a first turn-on signal, i.e., a high-level signal, and the second driving line 20 transmits a second turn-on signal, i.e., a high-level signal. The first writing transistor T11 is turned on under a control of the first turn-on signal, the first sensing transistor T12 is turned on under a control of the second turn-on signal, so that a data voltage $V_{data}$ (i.e., high-level voltage) output from the data line 30 is written into the control terminal (i.e., the point g1) of the first driving transistor T13, and the reference voltage VREF (i.e., a low-level voltage) output from the sensing line 40 is written into the first node s1. For example, as shown in FIG. 4, the reference voltage VREF may be written into the sensing line 40 by controlling a first switch K1 in an external circuit 90 to be closed, thereby writing the reference voltage VREF (i.e., the low-level voltage) output from the sensing line 40 into the first node s1 through the turned-on first sensing transistor T12.

In some embodiments of the present disclosure, the external circuit 90 may be provided in a driver chip, so as to improve degree of circuit integration. In some embodiments of the present disclosure, the external circuit 90 may also be provided on the display panel.

In a first charging phase T2' of the sense mode, the first driving line 10 transmits a first turn-off signal, i.e., a low level signal, and the second driving line 20 transmits the second turn-on signal, i.e., the high level signal. The first writing transistor T11 is turned off under a control of the first turn-off signal, the first sensing transistor T12 is turned on under the control of the second turn-on signal. A potential of the control terminal (i.e. the g1 point) of the first driving transistor T13 is maintained at a high potential through the first storage capacitor C1. The first driving transistor T13 is turned on, and a current flowing through the first driving transistor T13 charges the first node s1 i.e., the first storage capacitor C1, so that a potential of the sensing line 40 changes with a potential of the first node s1.

In a first sampling phase T3' of the sense mode, the first driving line 10 transmits the first turn-off signal, i.e., the low level signal, and the second driving line 20 transmits the second turn-on signal, i.e., the high level signal. The first writing transistor T11 is turned off under the control of the first turn-off signal. In this case, the potential of the first node 51 is $V_{data}$-$V_{th}$, here $V_{th}$ is a threshold voltage of the first driving transistor T13. The first sensing transistor T12 is turned on under the control of the second turn-on signal, so as to read the potential of the sensing line 40 through the external circuit 90, thereby sensing the threshold voltage of the first driving transistor T13. For example, as shown in FIG. 4, a second switch K2 in the external circuit 90 may be controlled to be closed, so that a sample holder S/H may sample and hold a voltage at the first node s1 through the turned-on first sensing transistor T12, and thus an analog-to-digital converter ADC senses the threshold voltage of the first driving transistor T13 according to an output signal of the sample holder S/H.

In a second data writing phase T11' of the sense mode, the first driving line 10 transmits the first turn-on signal, the high-level signal, and the second driving line 20 transmits the second turn-on signal, i.e., the high-level signal. The second writing transistor T21 is turned on under the control of the second turn-on signal, the second sensing transistor T22 is turned on under the control of the first turn-on signal, so that the data voltage $V_{data}$ (i.e., the high-level voltage) transmitted on the data line 30 is written into the control terminal (i.e., the g2 point) of the second driving transistor T23, and the reference voltage VREF (i.e., the low-level voltage) output from the sensing line 40 is written into the second node s2. For example, as shown in FIG. 4, the reference voltage VREF may be written into the sensing line 40 by controlling the first switch K1 in the external circuit 90 to be closed, thereby writing the reference voltage VREF (i.e., the low-level voltage) output from the sensing line 40 into the second node s2 through the turned-on second sensing transistor T22.

In a second charging phase T22' of the sense mode, the second driving line 20 transmits a second turn-off signal, i.e., a low level signal, and the first driving line 10 transmits the first turn-on signal, i.e., the high level signal. The second writing transistor T21 is turned off under a control of the second turn-off signal, and the second sensing transistor T22 is turned on under the control of the first turn-on signal. A potential of the control terminal (i.e., the g2 point) of the second driving transistor T23 is maintained at a high potential through the second storage capacitor C2. The second driving transistor T23 is turned on, and a current flowing through the second driving transistor T23 charges the second node s2, i.e., the second storage capacitor C2, so that the potential of the sensing line 40 changes with a potential of the second node s2.

In a second sampling phase T33' of the sense mode, the second driving line 20 transmits the second turn-off signal, i.e., the low level signal, and the first driving line 10 transmits the first turn-on signal, i.e., the high level signal. The second writing transistor T21 is turned off under the control of the second turn-off signal. In this case, the potential of the second node s2 is $V_{data}$-$V_{th}'$, here $V_{th}'$ is a threshold voltage of the second driving transistor T23. The second sensing transistor T22 is turned on under the control of the first turn-on signal, so as to read the potential of the sensing line 40 through the external circuit 90, thereby sensing the threshold voltage of the second driving transistor T23. For example, as shown in FIG. 4, the second switch K2 in the external circuit 90 may be controlled to be closed, so that the sample holder may sample and hold a voltage at the second node s2 through the turned-on second sensing transistor T22, and thus the analog-to-digital converter ADC senses the threshold voltage of the second driving transistor T23 according to the output signal of the sample holder S/H.

As shown in FIG. 6 in a data writing-back phase T4' of the sense mode, the first driving line 10 transmits the first turn-on signal, i.e., the high level signal, and the second driving line 20 transmits the second turn-on signal, the high level signal. The first writing transistor T11 and the second sensing transistor T22 are turned on under the control of the first turn-on signal, the first sensing transistor T12 and the second writing transistor T21 are turned on under the control of the second turn-on signal, so that the data voltage (i.e., the high-level voltage) output from the data line 30 is written into the control terminal (i.e., the g1 point) of the first driving transistor T13 and the control terminal (i.e., the g2 point) of the second driving transistor T23 synchronously, and the reference voltage VREF (i.e., the low-level voltage) output from the sensing line 40 is written into the first node s1 and the second node s2 synchronously. For example, as shown in FIG. 4, the reference voltage VREF may be written into the sensing line 40 by controlling the first switch K1 in the external circuit 90 to be closed, thereby writing the reference voltage VREF (i.e., the low-level voltage) output from the sensing line 40 into the first node s1 and the second node s2 through the turned-on first sensing transistor T12 and the turned-on second sensing transistor T22. The second terminal of the first driving transistor T13 and the terminal of the first light-emitting unit 70 are connected to the first node s1, and the second terminal of the second driving transistor T23 and the terminal of the second light-emitting unit 80 are connected to the second node s2.

It will be understood that, in the data writing-back phase T4' of the sense mode, the first pixel sub-circuit 50 and the second pixel sub-circuit 60 perform the data writing-back synchronously. That is, the first writing transistor T11 in the first pixel sub-circuit 50 and the second sensing transistor T22 in the second pixel sub-circuit 60 are turned on synchronously, and the second writing transistor T21 in the second pixel sub-circuit 60 and the first sensing transistor T12 in the first pixel sub-circuit 50 are turned on synchronously. Moreover, the first writing transistor T11 and the second writing transistor T11 are turned on synchronously, so as to write the same data voltage into the control terminal of the first driving transistor T13 and the control terminal of the second driving transistor T23. The first sensing transistor T12 and the second sensing transistor T22 are turned on synchronously, so as to write the same reference voltage into the first node s1 and the second node s2.

Since the data voltages transmitted on the data line 30 are not same in the two operation modes (i.e., the display mode and the sense mode) of the pixel circuit 100, the data voltage used in the sense mode cannot be used in the display mode. By providing the data writing-back phase T4' at the end of the sense mode, the data voltage transmitted on the data line 30 is able to be changed in the data writing-back phase T4' of the sense mode, so that after the sense mode is finished, the data voltage on the data line 30 is adjusted to be applicable to the display mode of the pixel circuit 100.

In summary, the pixel circuit in accordance with some embodiments of the present disclosure includes the first driving line 10, the second driving line 20, the data line 30, the sensing line 40, the first pixel sub-circuit 50 and the second pixel sub-circuit 60. The first pixel sub-circuit 50 includes the first writing unit 51, the first sensing unit 52, and the first driving unit 53. The first writing unit 51 is connected to the data line 30, the first sensing unit 52 is connected to the sensing line 40, and the first driving unit 53 is connected to the first light-emitting unit 70 to drive the first light-emitting unit 70 to emit light. The second pixel sub-circuit 60 includes the second writing unit 61, the second sensing unit 62 and the second driving unit 63. The second writing unit 61 is connected to the data line 30, the second sensing unit 62 is connected to the sensing line 40, and the second driving unit 63 is connected to the second light-emitting unit 80 to drive the second light-emitting unit 80 to emit light. The first writing unit 51 and the second sensing unit 62 are connected to the first driving line 10, so as to be turned on or off synchronously under the control of the first driving line 10. The second writing unit 61 and the first sensing unit 52 are connected to the second driving line 20, so as to be turned on or off synchronously under the control of the second driving line 20. Therefore, in the pixel circuit 100 in some embodiments of the present disclosure, by connecting the first writing unit 51 in the first pixel sub-circuit 50 and the second sensing unit 62 in the second pixel sub-circuit 60 to one driving line, and by connecting the second writing unit 61 in the second pixel sub-circuit 60 and the first sensing unit 52 in the first pixel sub-circuit 50 to another driving line, two pixel sub-circuits (i.e., the first pixel sub-circuit 50 and the second pixel sub-circuit 60) in each pixel circuit 100 are only required to be connected to two output terminals of gate driving units in two rows. That is, only one output terminal is required for each row gate driving unit in the gate driving circuit corresponding to the pixel circuits 100, so that the number of output terminals of the gate driving circuit may be reduced, thereby reducing the bezel of the display panel.

In some embodiments, a turn-on duration of the first writing unit 51 is at least partially overlapped with a turn-on duration of the second sensing unit 62; and a turn-on duration of the second writing unit 61 is at least partially overlapped with a turn-on duration of the first sensing unit 52.

Figure 7:
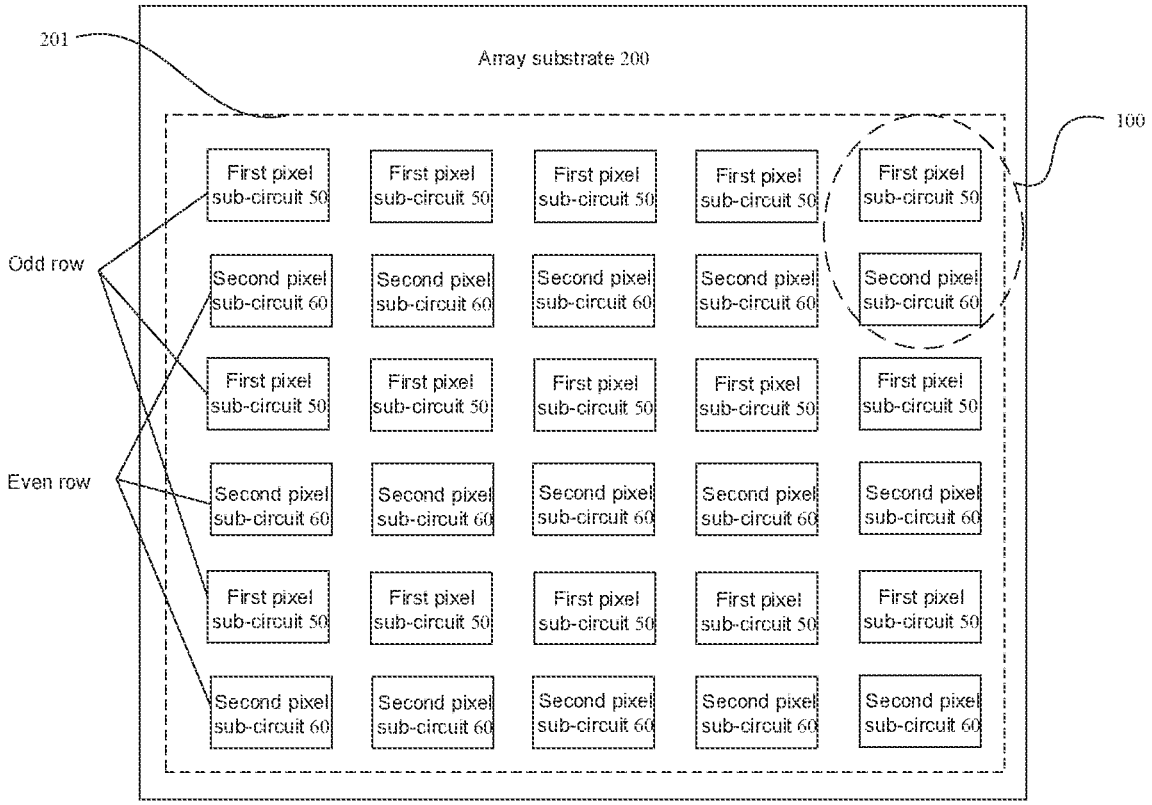
FIG. 7 is a block diagram of an array substrate, in accordance with some embodiments.

Based on the pixel circuit 100 in the embodiments, some embodiments of the present disclosure further provide the array substrate 200. As shown in FIG. 7, the array substrate 200 includes the pixel circuits 100 in any one of the above embodiments.

For example, as shown in FIG. 7, the first pixel sub-circuits 50 and the second pixel sub-circuit 60 in the pixel circuit 100 are located in two adjacent rows of a pixel array 201, respectively; and the pixel array 201 includes a plurality of pixel sub-circuits arranged in an array.

For example, the pixel array 201 has N rows and M columns, and N is an even number. Then, the pixel array 201 of N rows and M columns includes N/2 by M (N/2×M) pixel circuits 100 in the embodiment in FIG. 2 or FIG. 4. That is, the pixel circuit 100 is arranged in two adjacent rows and in the same column of the pixel array 201. That is, in each column of the pixel array 201 a (2i-1)-th row and a 2i-th row may be constructed from the pixel circuit 100 in the embodiment in FIG. 2 or FIG. 4, and i=1, 2 . . . N/2.

In some examples, the first pixel sub-circuits 50 in the pixel circuits 100 are located in odd rows of the pixel array 201, and the second pixel sub-circuits 60 in the pixel circuits 100 are located in even rows of the pixel array 201 (as shown in FIG. 7).

In some other examples, the first pixel sub-circuits 50 in the pixel circuits 100 may also be located in the even rows of the pixel array 201, and the second pixel sub-circuits 60 in the pixel circuits 100 are located in the odd rows of the pixel array 201.

Figure 8:
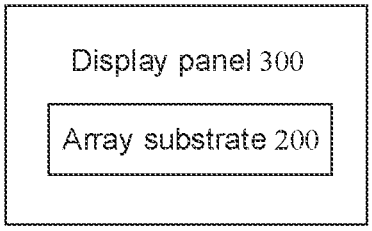
FIG. 8 is a block diagram of a display panel, in accordance with some embodiments.

FIG. 8 is a schematic block diagram of the display panel 300 in accordance with some embodiments of the present disclosure. As shown in FIG. 8, the display panel 300 includes the array substrate 200 in any one of the above embodiments.

In the display panel 300 in some embodiments of the present disclosure, by providing the array substrate 200, in which the first writing unit 51 in the first pixel sub-circuit 50 and the second sensing unit 62 in the second pixel sub-circuit 60 are connected to one driving line and the second writing unit 61 in the second pixel sub-circuit 60 and the first sensing unit 52 in the first pixel sub-circuit 50 are connected to another driving line, two pixel sub-circuits (i.e., the first pixel sub-circuit 50 and the second pixel sub-circuit 60) in each pixel circuit 100 are only required to be connected to two output terminals of gate driving units in two rows. That is, only one output terminal is required for each row gate driving unit in the gate driving circuit corresponding to the pixel circuits 100, so that the number of output terminals of the gate driving circuit may be reduced, thereby reducing a bezel of the display panel 300.

Figure 9:
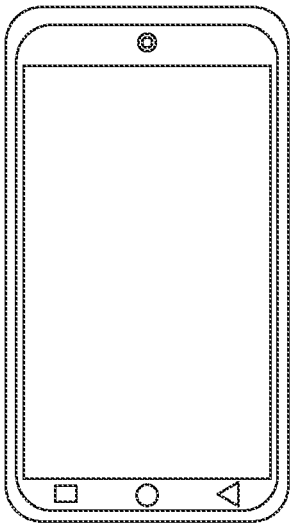
FIG. 9 is a structural diagram of an electronic device, in accordance with some embodiments.

Based on the display panel 300 in the above embodiments, as shown in FIG. 9, some embodiments of the present disclosure further provide the electronic device 400, including the display panel 300.

The electronic device 400 may be a display apparatus, and the display apparatus may be, for example, any component with a display function, such as a TV, a digital camera, a mobile phone, a watch, a tablet computer, a notebook computer, or a navigator.

In the electronic device 400 in some embodiments of the present disclosure, by providing the display panel 300, in which the first writing unit 51 in the first pixel sub-circuit 50 and the second sensing unit 62 in the second pixel sub-circuit 60 are connected to one driving line and the second writing unit 61 in the second pixel sub-circuit 60 and the first sensing unit 52 in the first pixel sub-circuit 50 are connected to another driving line, two pixel sub-circuits (i.e., the first pixel sub-circuit 50 and the second pixel sub-circuit 60) in each pixel circuit 100 are only required to be connected to two output terminals of gate driving units in two rows. That is, only one output terminal is required for each row gate driving unit in the gate driving circuit corresponding to the pixel circuits 100, so that the number of output terminals of the gate driving circuit may be reduced, thereby reducing a bezel of the electronic device 400.

Figure 10:
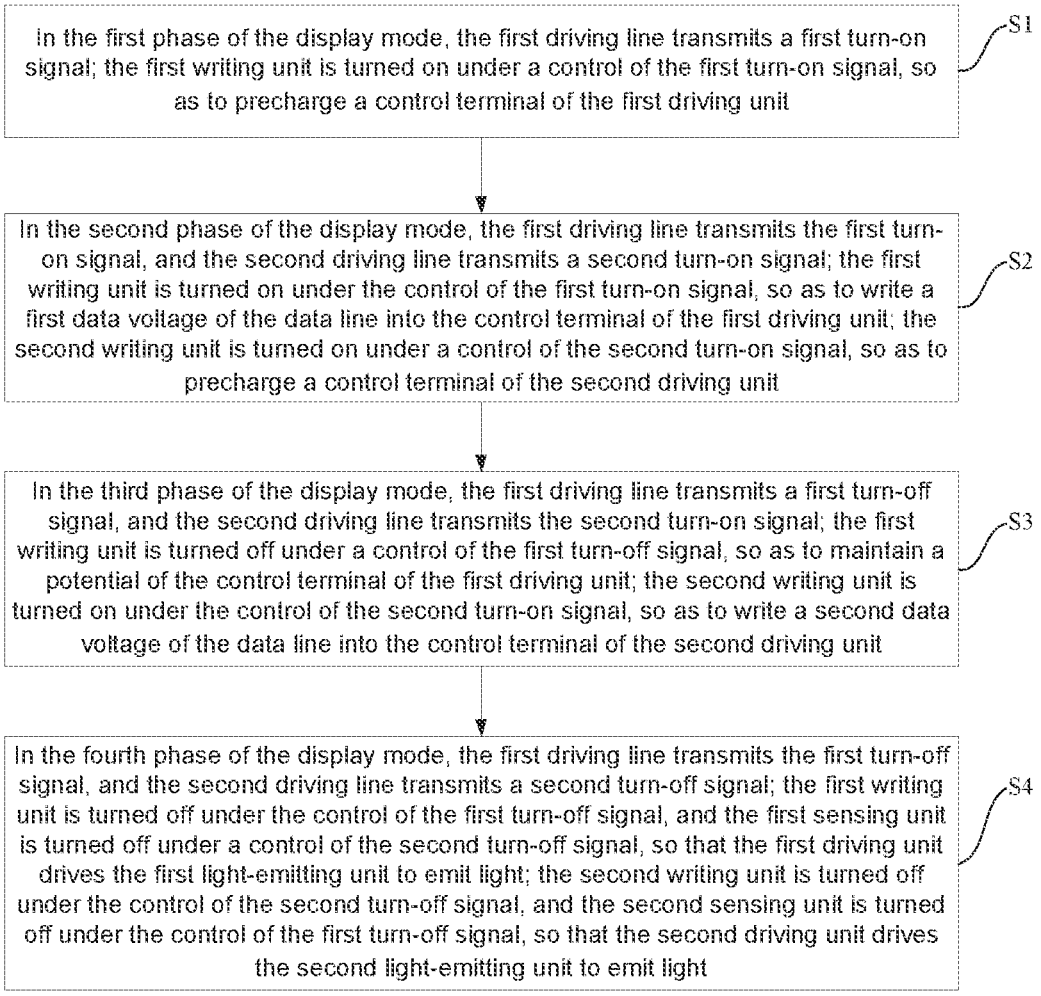
FIG. 10 is a flow diagram of a driving method of a pixel circuit, in accordance with some embodiments.

Based on the pixel circuit 100 in the above embodiments, some embodiments of the present disclosure further provided a driving method of a pixel circuit for driving the pixel circuit 100. An operation mode of the pixel circuit 100 includes a display mode. In the display mode, the driving method includes at least one first period, and the first period includes first to fourth phases. FIG. 10 is a schematic flow diagram of a driving method of a pixel circuit in accordance with some embodiments of the present disclosure. As shown in FIG. 10, the driving method of the pixel circuit in some embodiments of the present disclosure includes following steps.

In S1, in the first phase of the display mode, the first driving line transmits a first turn-on signal, and the first writing unit is turned on under a control of the first turn-on signal, so as to precharge the control terminal of the first driving unit.

In S2, in the second phase of the display mode, the first driving line transmits the first turn-on signal, and the second driving line transmits a second turn-on signal. The first writing unit is turned on under the control of the first turn-on signal, so as to write a first data voltage of the data line into the control terminal of the first driving unit. The second writing unit is turned on under a control of the second turn-on signal, so as to precharge the control terminal of the second driving unit.

In some embodiments of the present disclosure, in the second phase of the display mode, the first data voltage is further compensated according to the cross voltage of the first light-emitting unit.

In S3, in the third phase of the display mode, the first driving line transmits a first turn-off signal, and the second driving line transmits the second turn-on signal. The first writing unit is turned off under a control of the first turn-off signal, so as to maintain a potential of the control terminal of the first driving unit. The second writing unit is turned on under the control of the second turn-on signal, so as to write a second data voltage of the data line into the control terminal of the second driving unit.

In some embodiments of the present disclosure, in the third phase of the display mode, the second data voltage is further compensated according to the cross voltage of the second light-emitting unit.

In S4, in the fourth phase of the display mode, the first driving line transmits the first turn-off signal, and the second driving line transmits a second turn-off signal. The first writing unit is turned off under the control of the first turn-off signal, and the first sensing unit is turned off under a control of the second turn-off signal, so that the first driving unit drives the first light-emitting unit to emit light. The second writing unit is turned off under the control of the second turn-off signal, and the second sensing unit is turned off under the control of the first turn-off signal, so that the second driving unit drives the second light-emitting unit to emit light.

Figure 11:
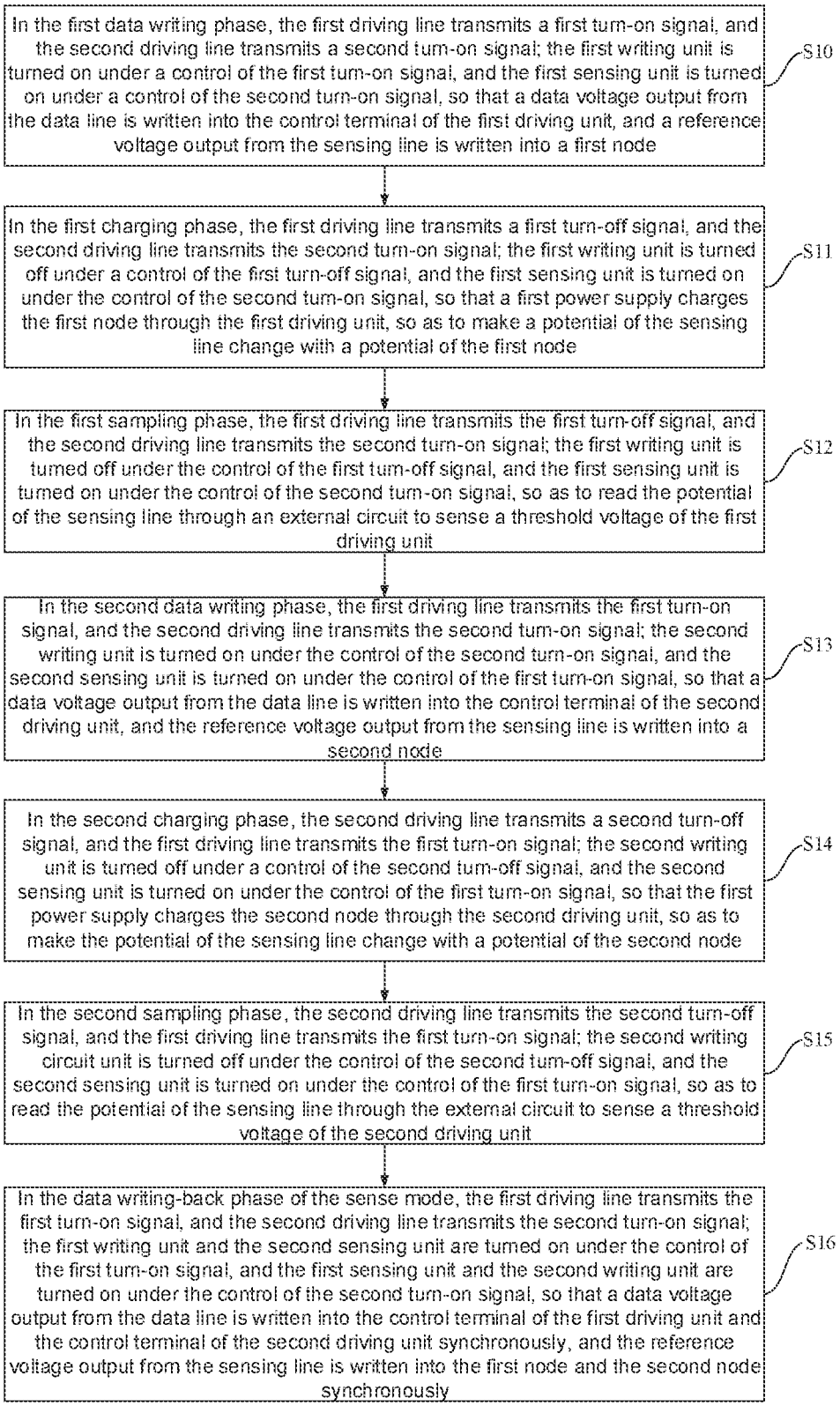
FIG. 11 is a flow diagram of another driving method of a pixel circuit, in accordance with some embodiments.

According to some embodiments of the present disclosure, the operation mode of the pixel circuit includes a sense mode. In the sense mode, the driving method includes at least one second period, and the second period includes a data writing-back phase. As shown in FIG. 11, the driving method of driving the pixel circuit in some embodiments of the present disclosure includes following steps.

In S16, in the data writing-back phase of the sense mode, the first driving line transmits a first turn-on signal, and the second driving line transmits a second turn-on signal. The first writing unit and the second sensing unit are turned on under the control of the first turn-on signal, and the first sensing unit and the second writing unit are turned on under the control of the second turn-on signal, so that a data voltage output from the data line is written into the control terminal of the first driving unit and the control terminal of the second driving unit synchronously, and a reference voltage output from the sensing line is written into the first node and the second node synchronously.

The first driving unit and the first light-emitting unit are connected to the first node, and the second driving unit and the second light-emitting unit are connected to the second node.

In some embodiments of the present disclosure, before the data writing-back phase of the sense mode, the second period further includes a first data writing phase, a first charging phase, and a first sampling phase. As shown in FIG. 11 the driving method of the pixel circuit in some embodiments of the present disclosure further includes following steps.

In S10, in the first data writing phase, the first driving line transmits the first turn-on signal, and the second driving line transmits the second turn-on signal. The first writing unit is turned on under the control of the first turn-on signal, and the first sensing unit is turned on under the control of the second turn-on signal, so that a data voltage output from the data line is written into the control terminal of the first driving unit, and a reference voltage output from the sensing line is written into the first node.

In S11, in the first charging phase, the first driving line transmits a first turn-off signal, and the second driving line transmits the second turn-on signal. The first writing unit is turned off under a control of the first turn-off signal, and the first sensing unit is turned on under the control of the second turn-on signal, so that the first power supply charges the first node through the first driving unit, so as to make a potential of the sensing line change with a potential of the first node.

In S12, in the first sampling phase, the first driving line transmits the first turn-off signal, and the second driving line transmits the second turn-on signal. The first writing unit is turned off under the control of the first turn-off signal, and the first sensing unit is turned on under the control of the second turn-on signal, so as to read the potential of the sensing line through an external circuit to sense a threshold voltage of the first driving unit.

In some embodiments of the present disclosure, before the data writing-back phase of the sense mode, and after the first sampling phase, the second period further includes a second data writing phase, a second charging phase, and a second sampling phase. As shown in FIG. 11, the driving method of the pixel circuit in some embodiments of the present disclosure further includes following steps.

In S13, in the second data writing phase, the first driving line transmits the first turn-on signal, and the second driving line transmits the second turn-on signal. The second writing unit is turned on under the control of the second turn-on signal, and the second sensing unit is turned on under the control of the first turn-on signal, so that a data voltage output from the data line is written into the control terminal of the second driving unit, and the reference voltage output from the sensing line is written into the second node.

In S14, in the second charging stage, the second driving line transmits a second turn-off signal, and the first driving line transmits the first turn-on signal. The second writing unit is turned off under a control of the second turn-off signal, and the second sensing unit is turned on under the control of the first turn-on signal, so that the first power supply charges the second node through the second driving unit, so as to make the potential of the sensing line change with a potential of the second node.

In S15, in the second sampling stage, the second driving line transmits the second turn-off signal, and the first driving line transmits the first turn-on signal. The second writing unit is turned off under the control of the second turn-off signal, and the second sensing unit is turned on under the control of the first turn-on signal, so as to read the potential of the sensing line through the external circuit to sense a threshold voltage of the second driving unit.

It will be noted that, the above explanations of the embodiments of the pixel circuit are also applicable to the driving method of the pixel circuit in the embodiments of the present disclosure, which will not be repeated here.

In summary, in the driving method of the pixel circuit 100 in the embodiments of the present disclosure, in the first phase of the display mode, the first driving line 10 transmits the first turn-on signal, and the first writing unit 51 is turned on under the control of the first driving line 10, so as to precharge the control terminal of the first driving unit 53. In the second phase of the display mode, the first driving line 10 transmits the first turn-on signal, and the second driving line 20 transmits the second turn-on signal, so that the first writing unit 51 is turned on under the control of the first turn-on signal, so as to write the first data voltage of the data line 30 into the control terminal of the first driving unit 53, and the second writing unit 61 is turned on under the control of the second turn-on signal, so as to precharge the control terminal of the second driving unit 63. In the third phase of the display mode, the first driving line 10 transmits the first turn-off signal, and the second driving line 20 transmits the second turn-on signal, so that the first writing unit 51 is turned off under the control of the first turn-off signal, so as to maintain the potential of the control terminal of the first driving unit 53, and the second writing unit 61 is turned on under the control of the second turn-on signal, so as to write the second data voltage of the data line 30 into the control terminal of the second driving unit 63. In the fourth phase of the display mode, the first driving line 10 transmits the first turn-off signal, and the second driving line 20 transmits the second turn-off signal, so that the first writing unit 51 is turned-off under the control of the first turn-off signal and the first sensing unit 52 is turned off under the control of the second turn-off signal, and thus the first driving unit 53 drives the first light-emitting unit 70 to emit light, and the second writing unit 61 is turned off under the control of the second turn-off signal and the second sensing unit 62 is turned off under the control of the first turn-off signal, and thus the second driving unit 63 drives the second light-emitting unit 80 to emit light. Therefore, in the driving method of the pixel circuit in some embodiments of the present disclosure, the first writing unit 51 in the first pixel sub-circuit 50 and the second sensing unit 62 in the second pixel sub-circuit 60 are connected to one driving line, the second writing unit 61 in the second pixel sub-circuit 60 and the first sensing unit 52 in the first pixel sub-circuit 52 are connected to another driving line, so that two pixel sub-circuits (i.e., the first pixel sub-circuit 50 and the second pixel sub-circuit 60) in each pixel circuit 100 are only required to be connected to two output terminals of gate driving units in two rows. That is, only one output terminal is required for each row gate driving unit in the gate driving circuit corresponding to the pixel circuits 100, so that the number of output terminals of the gate driving circuit may be reduced, thereby reducing the bezel of the display panel.

The above are merely specific implementation manners of the present disclosure, but the protection scope of the present disclosure is not limited thereto, and changes or replacements that any person skilled in the art could conceive of within the technical scope of the present disclosure should be included in the protection scope of the present disclosure. Therefore, the protection scope of the present disclosure shall be subject to the protection scope of the claims.

What is claimed is:

1. A pixel circuit, comprising:

a data line and a sensing line;

a first pixel sub-circuit including a first writing unit, a first sensing unit and a first driving unit, the first writing unit being connected to the data line and the first driving unit, the first sensing unit being connected to the sensing line and the first driving unit, and the first driving unit being configured to be connected to a first light-emitting unit to drive the first light-emitting unit to emit light; and a second pixel sub-circuit including a second writing unit, a second sensing unit and a second driving unit, the second writing unit being connected to the data line and the second driving unit, the second sensing unit being connected to the sensing line and the second driving unit, and the second driving unit being configured to be connected to a second light-emitting unit to drive the second light-emitting unit to emit light; wherein the first writing unit and the second sensing unit are both configured to be connected to a gate driving unit; and the second writing unit and the first sensing unit are both configured to be connected to another gate driving unit.

2. The pixel circuit according to claim 1, further comprising a first driving line and a second driving line, wherein the first writing unit and the second sensing unit are both connected to the first driving line, and the first driving line is configured to be connected to the gate driving unit; and the second writing unit and the first sensing unit are both connected to the second driving line, and the second driving line is configured to be connected to the another gate driving unit.

3. The pixel circuit according to claim 1, wherein an effective-level duration of a signal transmitted by the first driving line is at least partially overlapped with an effective-level duration of another signal transmitted by the second driving line.

4. The pixel circuit according to claim 1, further comprising a first driving line and a second driving line, wherein a first terminal of the first writing unit is connected to the data line, and a control terminal of the first writing unit is connected to the first driving line;

a first terminal of the first sensing unit is connected to the sensing line, and a control terminal of the first sensing unit is connected to the second driving line;

a control terminal of the first driving unit is connected to a second terminal of the first writing unit, a first terminal of the first driving unit is configured to be connected to a first power supply, a second terminal of the first driving unit is connected to a second terminal of the first sensing unit, and the second terminal of the first driving unit is configured to be connected to the first light-emitting unit;

a first terminal of the second writing unit is connected to the data line, and a control terminal of the second writing unit is connected to the second driving line;

a first terminal of the second sensing unit is connected to the sensing line, and a control terminal of the second sensing unit is connected to the first driving line;

a control terminal of the second driving unit is connected to a second terminal of the second writing unit, a first terminal of the second driving unit is configured to be connected to the first power supply, a second terminal of the second driving unit is connected to a second terminal of the second sensing unit, and the second terminal of the second driving unit is configured to be connected to second light-emitting unit.

5. The pixel circuit according to claim 4, wherein the first writing unit includes a first writing transistor; and a first terminal, a second terminal and a control terminal of the first writing transistor are the first terminal, the second terminal and the control terminal of the first writing unit, respectively; and the second writing unit includes a second writing transistor; and a first terminal, a second terminal and a control terminal of the second writing transistor are the first terminal, the second terminal and the control terminal of the second writing unit, respectively.

6. The pixel circuit according to claim 4, wherein the first sensing unit includes a first sensing transistor; and a first terminal, a second terminal and a control terminal of the first sensing transistor are the first terminal, the second terminal and the control terminal of the first sensing unit, respectively; and the second sensing unit includes a second sensing transistor; and a first terminal, a second terminal and a control terminal of the second sensing transistor are the first terminal, the second terminal and the control terminal of the second sensing unit, respectively.

7. The pixel circuit according to claim 4, wherein the first driving unit includes a first driving transistor and a first storage capacitor; a first terminal, a second terminal and a control terminal of the first driving transistor are the first terminal, the second terminal and the control terminal of the first driving unit, respectively; a terminal of the first storage capacitor is connected to the control terminal of the first driving transistor, and another terminal of the first storage capacitor is connected to the second terminal of the first driving transistor; and the second driving unit includes a second driving transistor and a second storage capacitor; a first terminal, a second terminal and a control terminal of the second driving transistor are the first terminal, the second terminal and the control terminal of the second driving unit, respectively; a terminal of the second storage capacitor is connected to the control terminal of the second driving transistor, and another terminal of the second storage capacitor is connected to the second terminal of the second driving transistor.

8. The pixel circuit according to claim 7, further comprising:

the first light-emitting unit, wherein a terminal of the first light-emitting unit is connected to the second terminal of the first driving transistor, and another terminal of the first light-emitting unit is configured to be connected to a second power supply; and the second light-emitting unit, wherein a terminal of the second light-emitting unit is connected to the second terminal of the second driving transistor, and another terminal of the second light-emitting unit is configured to be connected to the second power supply.

9. The pixel circuit according to claim 2, wherein the first driving line and the second driving line are configured to be connected to output terminals of gate driving units in two adjacent rows in a gate driving circuit.

10. The pixel circuit according to claim 1, wherein a turn-on duration of the first writing unit is at least partially overlapped with a turn-on duration of the second sensing unit; and a turn-on duration of the second writing unit is at least partially overlapped with a turn-on duration of the first sensing unit.

11. An array substrate, comprising a plurality of pixel circuits according to claim 1.

12. The array substrate according to claim 11, wherein first pixel sub-circuits and second pixel sub-circuits in the plurality of pixel circuits constitute a pixel array; the first pixel sub-circuit and the second pixel sub-circuit in a pixel circuit in the plurality of pixel circuits are located in two adjacent rows of the pixel array.

13. A display panel, comprising the array substrate according to claim 11.

14. An electronic device, comprising the display panel according to claim 13.

15. A driving method of a pixel circuit, for driving the pixel circuit according to claim 1, wherein the pixel circuit further includes a first driving line and a second driving line; the first writing unit and the second sensing unit are both connected to the first driving line, and the first driving line is configured to be connected to the gate driving unit; the second writing unit and the first sensing unit are both connected to the second driving line, and the second driving line is configured to be connected to the another gate driving unit;

an operation mode of the pixel circuit includes a display mode; in the display mode, the method comprises at least one first period, and a first period in the at least one first period includes first to fourth phases, wherein in the first phase of the display mode, the first driving line transmits a first turn-on signal; the first writing unit is turned on under a control of the first turn-on signal, so as to precharge a control terminal of the first driving unit;

in the second phase of the display mode, the first driving line transmits the first turn-on signal, and the second driving line transmits a second turn-on signal; the first writing unit is turned on under the control of the first turn-on signal, so as to write a first data voltage of the data line into the control terminal of the first driving unit; the second writing unit is turned on under a control of the second turn-on signal, so as to precharge a control terminal of the second driving unit;

in the third phase of the display mode, the first driving line transmits a first turn-off signal, and the second driving line transmits the second turn-on signal; the first writing unit is turned off under a control of the first turn-off signal, so as to maintain a potential of the control terminal of the first driving unit; the second writing unit is turned on under the control of the second turn-on signal, so as to write a second data voltage of the data line into the control terminal of the second driving unit; and in the fourth phase of the display mode, the first driving line transmits the first turn-off signal, and the second driving line transmits a second turn-off signal; the first writing unit is turned off under the control of the first turn-off signal, and the first sensing unit is turned off under a control of the second turn-off signal, so that the first driving unit drives the first light-emitting unit to emit light; the second writing unit is turned off under the control of the second turn-off signal, and the second sensing unit is turned off under the control of the first turn-off signal, so that the second driving unit drives the second light-emitting unit to emit light.

16. The driving method of the pixel circuit according to claim 15, wherein the operation mode of the pixel circuit further includes a sense mode; in the sense mode, the method comprises at least one second period, and a second period in the at least one second period includes a data writing-back phase, wherein in the data writing-back phase of the sense mode, the first driving line transmits a first turn-on signal, and the second driving line transmits a second turn-on signal; the first writing unit and the second sensing unit are turned on under a control of the first tuna-on signal, and the first sensing unit and the second writing unit are turned on under a control of the second turn-on signal, so that a data voltage output from the data line is written into the control terminal of the first driving unit and the control terminal of the second driving unit synchronously, and a reference voltage output from the sensing line is written into a first node and a second node synchronously, wherein the first driving unit and the first light-emitting unit are connected to the first node, and the second driving unit and the second light-emitting unit are connected to the second node.

17. The driving method of the pixel circuit according to claim 16, wherein before the data writing-back phase of the sense mode, the second period further includes a first data writing phase, a first charging phase and a first sampling phase;

in the first data writing phase, the first driving line transmits the first turn-on signal, to and the second driving line transmits the second turn-on signal; the first writing unit is turned on under the control of the first turn-on signal, and the first sensing unit is turned on under the control of the second turn-on signal, so that a data voltage output from the data line is written into the control terminal of the first driving unit, and the reference voltage output from the sensing line is written into the first node;

in the first charging phase, the first driving line transmits a first turn-off signal, and the second driving line transmits the second turn-on signal; the first writing unit is turned off under a control of the first turn-off signal, and the first sensing unit is turned on under the control of the second turn-on signal, so that the first power supply charges the first node through the first driving unit, so as to make a potential of the sensing line change with a potential of the first node; and in the first sampling phase, the first driving line transmits the first turn-off signal, and the second driving line transmits the second turn-on signal; the first writing unit is turned off under the control of the first turn-off signal, and the first sensing unit is turned on under the control of the second turn-on signal, so as to read the potential of the sensing line through an external circuit to sense a threshold voltage of the first driving unit.

18. The driving method of the pixel circuit according to claim 17, wherein before the data writing-back phase of the sense mode and after the first sampling phase, the second period further includes a second data writing phase, a second charging phase and a second sampling phase;

in the second data writing phase, the first driving line transmits the first turn-on signal, and the second driving line transmits the second turn-on signal; the second writing unit is turned on under the control of the second turn-on signal, and the second sensing unit is turned on under the control of the first turn-on signal, so that a data voltage output from the data line is written into the control terminal of the second driving unit, and the reference voltage output from the sensing line is written into the second node;

in the second charging phase, the second driving line transmits a second turn-off signal, and the first driving line transmits the first turn-on signal; the second writing unit is turned off under a control of the second turn-off signal, and the second sensing unit is turned on under the control of the first turn-on signal, so that the first power supply charges the second node through the second driving unit, so as to make the potential of the sensing line change with a potential of the second node; and in the second sampling phase, the second driving line transmits the second turn-off signal, and the first driving line transmits the first turn-on signal; the second writing unit is turned off under the control of the second turn-off signal, and the second sensing unit is turned on under the control of the first turn-on signal, so as to read the potential of the sensing line through the external circuit to sense a threshold voltage of the second driving unit.

19. The driving method of the pixel circuit according to claim 15, further comprising:

in the second phase of the display mode, compensating the first data voltage according to a cross voltage of the first light-emitting unit.

20. The driving method of the pixel circuit according to claim 15, further comprising:

in the third phase of the display mode, compensating the second data voltage according to a cross voltage of the second light-emitting unit.

* * * * *